US011147400B1

(12) United States Patent
Gorea

(10) Patent No.: US 11,147,400 B1
(45) Date of Patent: Oct. 19, 2021

(54) ROLL-OUT DISPOSABLE BEDDING

(71) Applicant: Judith A. Gorea, Utica, NY (US)

(72) Inventor: Judith A. Gorea, Utica, NY (US)

( * ) Notice: Subject to any disclaimer, the term of this patent is extended or adjusted under 35 U.S.C. 154(b) by 269 days.

(21) Appl. No.: 16/156,599

(22) Filed: Oct. 10, 2018

(51) Int. Cl.

| | |
|---|---|
| ***A47G 9/02*** | (2006.01) |
| ***A47C 21/02*** | (2006.01) |
| ***A47C 19/02*** | (2006.01) |
| ***A47G 11/00*** | (2006.01) |

(52) U.S. Cl.
CPC ..... *A47G 9/0253* (2013.01); *A47C 19/022* (2013.01); *A47C 21/028* (2013.01); *A47G 11/007* (2013.01); *Y10T 428/19* (2015.01)

(58) Field of Classification Search
CPC ... A47C 21/028; A47C 27/005; A47C 19/022; A47G 9/0238; A47G 11/007; Y10T 428/19
See application file for complete search history.

(56) References Cited

U.S. PATENT DOCUMENTS

| | | | | |
|---|---|---|---|---|
| 2,339,828 | A | 1/1944 | Worth | |
| 3,343,183 | A | 9/1967 | Sannes | |
| 3,344,444 | A | 10/1967 | McNeal | |
| 3,388,406 | A | 6/1968 | Scrivener | |
| 3,466,679 | A | 9/1969 | Hess | |
| 3,641,600 | A | 2/1972 | Oats | |
| 4,025,973 | A * | 5/1977 | Walbrecht | A47C 19/022 5/488 |
| 4,042,985 | A * | 8/1977 | Raczkowski | A47C 21/028 5/488 |
| 5,718,009 | A * | 2/1998 | Lin | A47C 21/028 5/487 |
| 2011/0214233 | A1* | 9/2011 | Stang | A47G 9/0238 5/488 |
| 2014/0000028 | A1* | 1/2014 | Pillay | A47G 9/02 5/487 |

* cited by examiner

*Primary Examiner* — David R Hare
*Assistant Examiner* — Madison Emanski
(74) *Attorney, Agent, or Firm* — Cramer Patent & Design, PLLC; Aaron R. Cramer

(57) ABSTRACT

A roll-out disposable bedding assembly, and a bed that uses that disposable bedding assembly, includes a bedding roll comprised of disposable bi-layered bedding materials, first and second mounting bracket assemblies, and a support axle. The first and second mounting bracket assemblies and support axle secure the bedding roll to a bed. The bedding roll is comprised of rolled up, sequentially attached rectangular bedding sections, at least one of which has a bi-layered construction of an upper sheet and a lower sheet. That bedding section is attached to adjacent bedding sections along perforated edges. The upper sheet and lower sheet are removably affixed to each other along parallel perforated side edges. The bottoms of the upper sheet and lower sheet are permanently affixed together. A pillowcase is disposed between the upper and lower sheet.

7 Claims, 3 Drawing Sheets

ROLL-OUT DISPOSABLE BEDDING

RELATED APPLICATIONS

Not applicable.

FIELD OF THE INVENTION

The presently disclosed subject matter is directed to bedding. More particularly, it is directed to a bedding assembly for quickly and easily replacing soiled bedding with disposable clean bedding.

BACKGROUND OF THE INVENTION

One very common but rather unpleasant household task is to replace soiled bedding materials with clean bedding materials. Bedding materials typically include at least a top sheet, a bottom sheet, and a pillow case. Replacing soiled bedding involves removing the soiled bedding materials from the bed, moving the soiled bedding materials to a location for cleaning and drying, placing clean bedding materials on the bed, remaking the bed, cleaning and drying the soiled bedding materials, and then transporting the now cleaned and dried bedding materials to a storage location for future use.

While replacing soiled bedding materials in the home is a common and generally unpleasant task, in some situations such as in hospitals, nursing homes, prisons, dormitories, college rooms and numerous other situations it can become a very time-consuming, expensive, and manually intensive task. Not only can changing soiled bedding take time and effort but the cleaning, drying, transporting, tracking and storing of bedding materials can require significant resources and effort. This is especially true when the soiled bedding materials have to be returned to their owners.

A partial solution to the problem of changing bedding materials is to use disposable bedding. With disposable bedding the soiled bedding materials can be removed from a bed, disposed of, and new disposable bedding materials can then be installed. While partially successful the disposable bedding materials still have to be located, transported to the desired location, and then installed on the bed.

Therefore, a new system for storing, handling and using disposable bedding materials is desirable. Ideally such a system would be easy to use, would store the disposable bedding at the needed location in an out-of-the-way place, and would be suitable for low cost, high speed bedding changes.

SUMMARY OF THE INVENTION

The principles of the present invention provide for disposable bedding rolls that reduce or eliminate the problems of storing and handling disposable bedding materials. Ideally such disposable bedding rolls would be easy to use, would store the disposable bedding materials at the needed location in an out-of-the-way place, and would be suitable for low cost, high speed bedding changes.

A roll-out disposable bedding assembly that is in accord with the present invention includes a bedding roll comprised of disposable bi-layered bedding materials, first and second mounting bracket assemblies, and a support axle. The first and second mounting bracket assemblies and support axle are for secure the bedding roll to an existing bed.

The bedding roll is beneficially comprised of rolled up, sequentially attached rectangular bedding sections. At least one bedding section has a bi-layered construction made of an upper sheet and a lower sheet. The at least one bedding section is attached to adjacent bedding sections along laterally perforated edges. Beneficially the upper sheet and lower sheet are removably affixed to each other along parallel perforated side edges. The upper sheet and lower sheet should have bottoms that are permanently affixed perforated edges. A pillowcase may be disposed between the upper and lower sheets. In practice the pillow case should be secured between the upper and lower sheet.

The bedding role is preferably supported along its sides by the first and second mounting bracket assemblies which are attached to an existing bed. The first and second mounting bracket assemblies each include overlapping rectangular first plates and second plates that are mirror images of one another. The first plate of the first mounting bracket assembly is attached to a bed frame using mounting apertures and fasteners. A pivot pin passes through both the first plate and the second plate of at least the first mounting bracket assembly. In any event the second plate of the first mounting bracket assembly receives the support axle. First and second locking apertures respectively pass through the first plate and the second plate of the first mounting bracket assembly. The locking apertures are brought into alignment by pivoting the second plate. Also includes are locking pins that can be inserted through the align first and second locking aperture so as to hold the bedding roll in a fixed orientation. The support axle is received in an axle aperture through the second plate of the first mounting bracket assembly. If so, a removable pin can retain an end of the support axle in that axle aperture. That pin can be removed to enable removal of the bedding roll.

A bed assembly that is in accord with the present invention includes a bed, a bedding roll comprised of disposable bi-layered bedding materials, first and second mounting bracket assemblies that are attached to the bed; and a support axle that is attached to the first and second mounting bracket assemblies and that holds the bedding roll. That bedding roll may be comprised of rolled up, sequentially attached rectangular bedding sections. The bedding section preferably has a bi-layered construction made of an upper sheet, a lower sheet and a pillow case that is disposed between the upper sheet and the lower sheet.

BRIEF DESCRIPTION OF THE DRAWINGS

The advantages and features of the present invention will become better understood with reference to the following detailed description and claims when taken in conjunction with the accompanying drawings, in which like elements are identified with like symbols, and in which:

DESCRIPTIVE KEY

Figure 1:
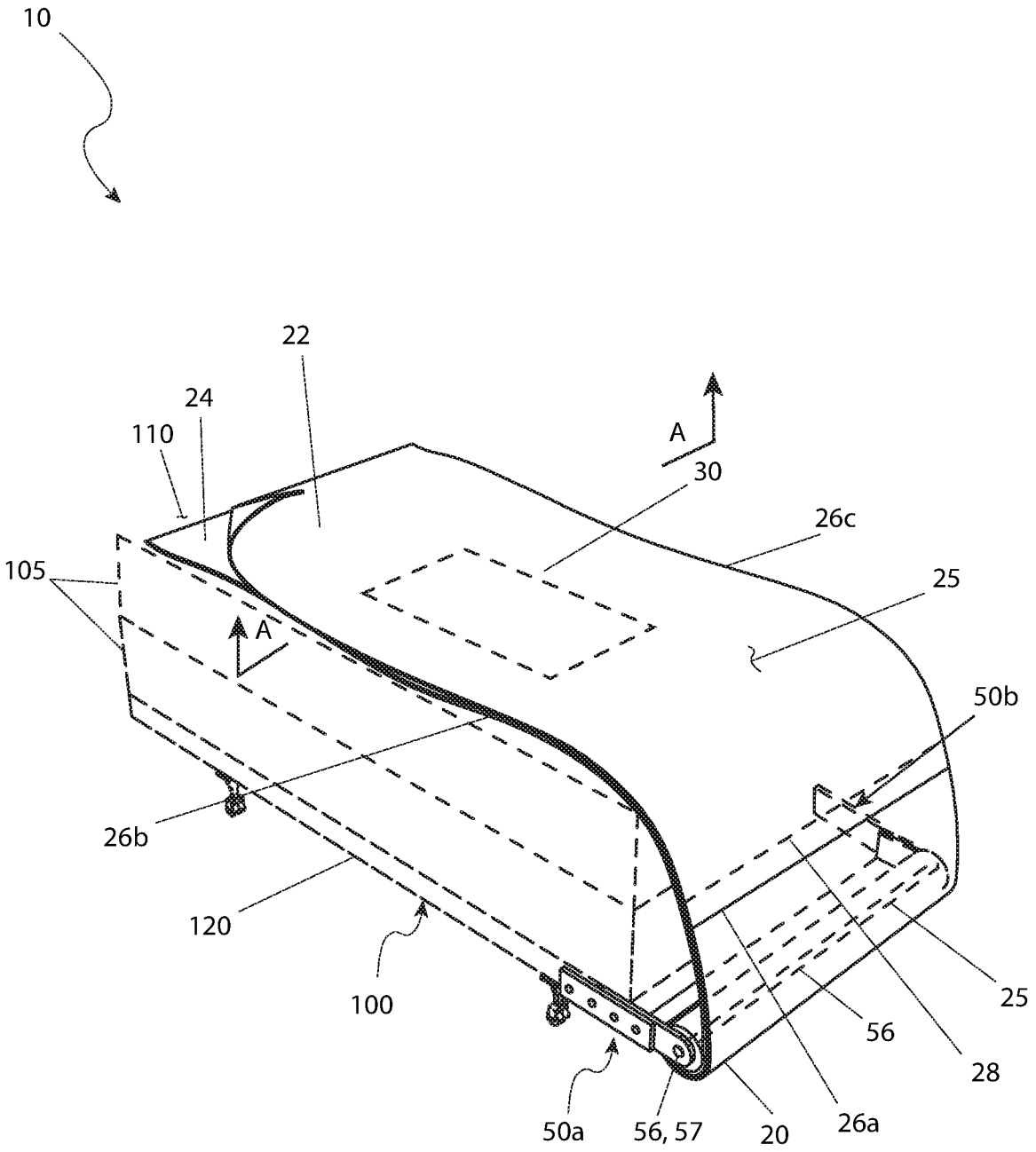
FIG. 1 is a perspective view of roll-out disposable bedding 10 which is in accord with the principles of the present invention.

10 roll-out disposable bedding
20 bedding roll
22 upper sheet
24 lower sheet

25 bedding section
26*a* laterally perforated edge
26*b* first perforated side edge
26*c* second perforated side edge
28 joining stitch
30 pillow case
32 adhesive
50*a* first mounting bracket assembly
50*b* second mounting bracket assembly
52 first plate
54 second plate
56 support axle
57 axle aperture
58 mounting aperture
60 pivot pin
62*a* first locking aperture
62*b* second locking aperture
80 fastener
82 locking pin
84 cotter pin
100 existing bed
105 mattress/box spring
110 top surface
120 frame

DETAILED DESCRIPTION OF THE PREFERRED EMBODIMENT

Figure 2:
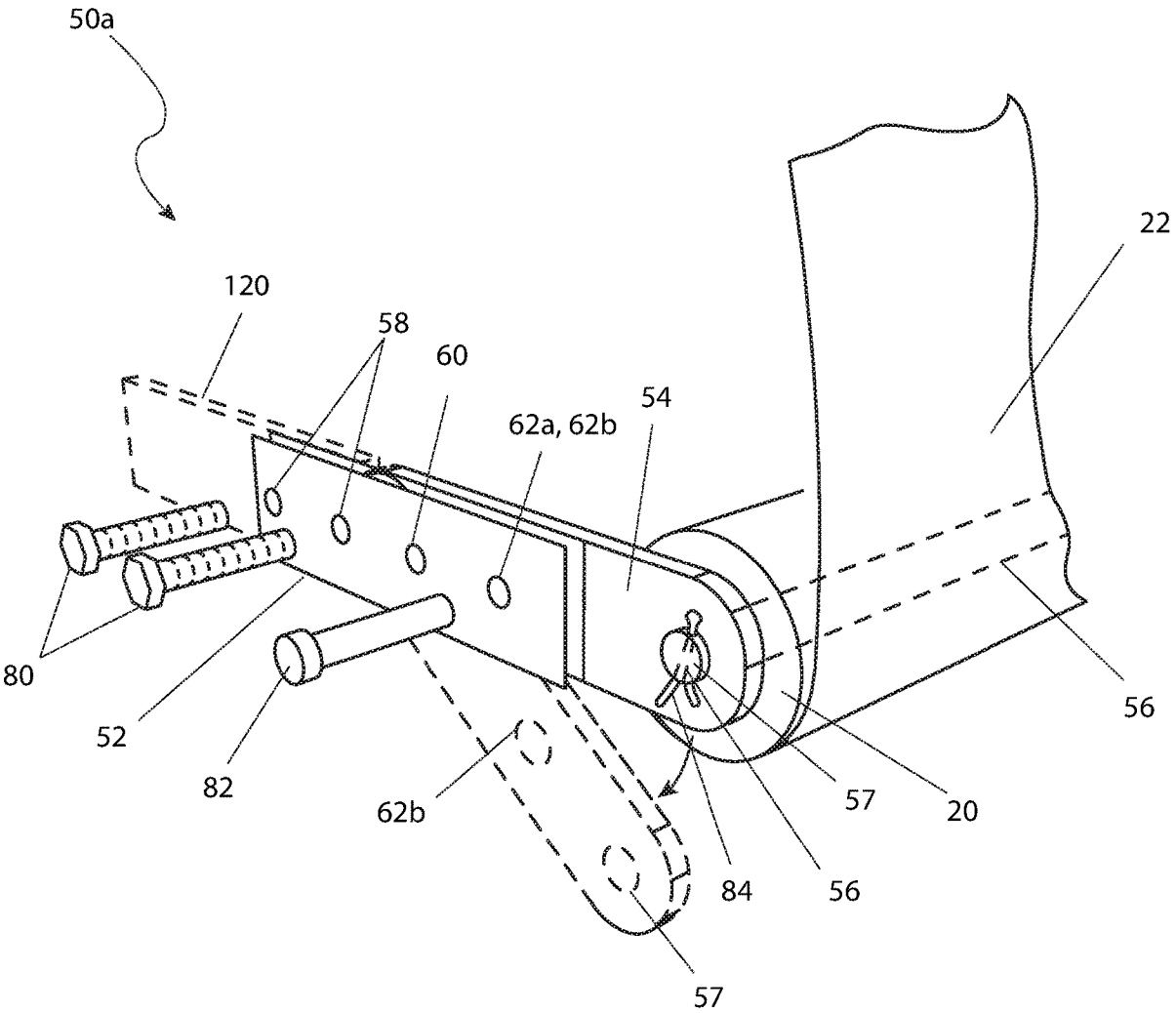
FIG. 2 is a close-up view of a mounting bracket assembly 50*a* used with the roll-out disposable bedding 10 shown in FIG. 1; and, FIG. 3 is a sectional view of a bedding section 25 of the roll-out disposable bedding 10 taken along section line A-A of FIG. 1.
Figure 3:
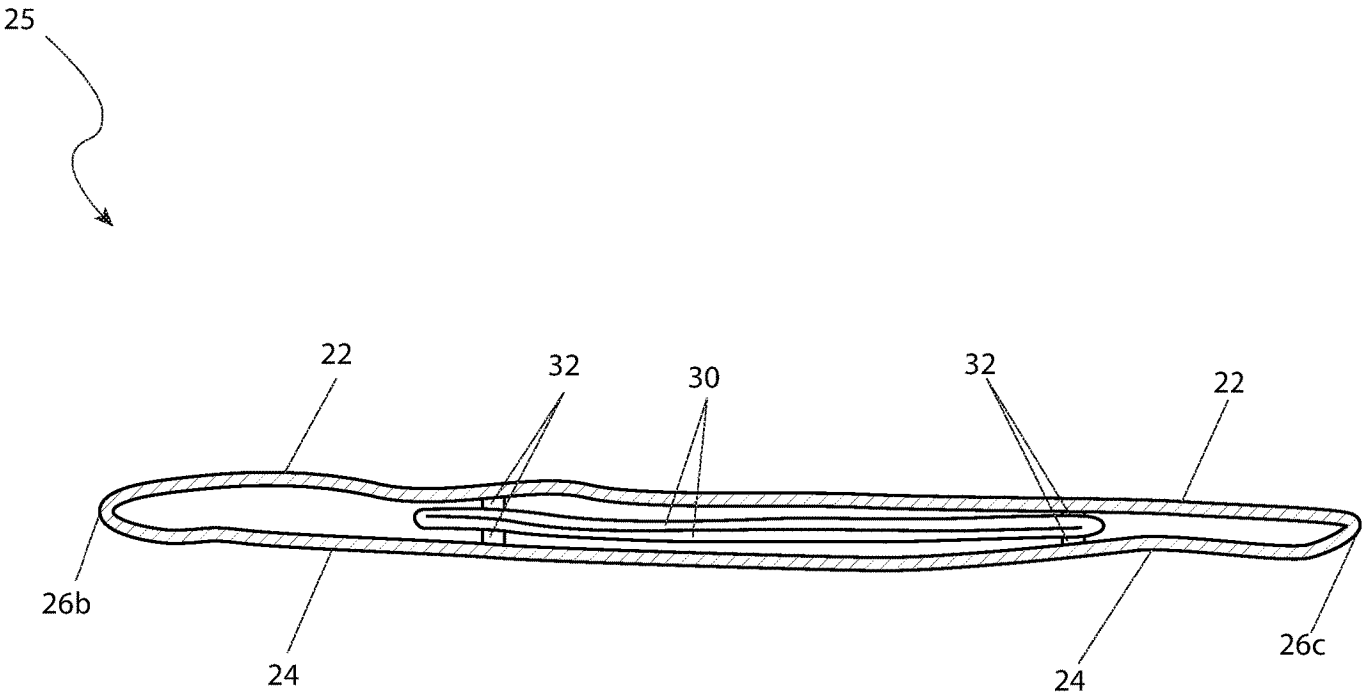

The preferred embodiment of the present invention is depicted in FIGS. 1 through 3. However, the invention is not limited to the specifically described embodiment. A person skilled in the art will appreciate that many other embodiments of the invention are possible without deviating from the basic concept of the invention. Any such work around will also fall under the scope of this invention.

The terms "a" and "an" as used herein do not denote a limitation of quantity, but rather denote the presence of at least one of the referenced items.

The present invention describes roll-out disposable bedding 10 which provides a bedding roll 20 made of disposable bi-layered bedding materials which are intended to replace conventional bed sheets in applications in which changing bedding is performed often or under difficult conditions. The roll-out disposable bedding 10 includes first and second mounting bracket assemblies 50*a*, 50*b* and a support axle 56 which are designed to secure the bedding roll 20 to an existing bed 100. The roll-out disposable bedding 10 is envisioned as being especially beneficial for college students, hospitals, bed & breakfast type establishments, and the like.

Referring now to FIG. 1, the bedding roll 20 is comprised of sequentially attached rectangular bedding sections 25 that are rolled up to form the bedding roll. The bedding sections 25 are preferably made using low-cost disposable materials. Each bedding section 25 has a bi-layered construction made of an upper sheet 22 and a lower sheet 24.

Each bedding section 25 is connected to and can be separated from adjacent bedding sections 25 by laterally perforated edges 26*a*. The perforated edges 26*a* enable a user to easily detach and dispose of a soiled bedding section 25. After a soiled bedding section 25 is detached a user can simply draw a clean bedding section 25 from the bedding role 20 and then place that clean bedding section 25 on top 110 of the mattress/box spring 105 of the existing bed 100.

The upper sheet 22 and lower sheet 24 are removably affixed to each other along parallel perforated first and second side edges 26*b*, 26*c*. The perforated first and second side edges 26*b*, 26*c* enable a user to selectively separate the upper and lower sheets 22, 24 as desired. Additionally, each bedding section 25 includes a lateral joining stitch 28 which permanently affixes the bottoms of the upper and lower sheets 22, 24 together. The joining stitch 28 is beneficially runs parallel to and is adjacent to the laterally perforated edge 26*a*.

Each bedding section 25 preferably includes a removably secured pillow case 30 that is temporarily positioned between the upper and lower sheets 22, 24 (also see FIG. 3).

The upper sheet 22, lower sheet 24, and pillow case 30 are intended to be manufactured from low-cost fabric materials which may be disposed of following use, such as, but not limited to: SMART-FAB®, PROMAX®, and the like. It is envisioned that the bedding roll 20 would provide specifically sized bedding sections 25 suitable for various bed sizes such as twin, full, queen, king sizes. Furthermore, it is envisioned that the bedding sections 25 and pillow cases 30 would be manufactured in a variety of attractive colors and patterns, based upon a user's preferences.

Referring now also to FIG. 2 the bedding role 20 is supported along its sides by the first mounting bracket assembly 50*a* and by the second mounting bracket assembly 50*b*. The roll-out disposable bedding (FIG. 1, 10) is envisioned as being made available with the necessary first and second mounting bracket assemblies (FIG. 1, 50*a*, 50*b*) to attach the bedding role 20 to an existing bed (FIG. 1, 100). The mounting bracket assemblies 50*a*, 50*b* may attach the bedding role 20 to the foot, a headboard, or a frame 120 of the existing bed 100.

The roll-out disposable bedding 10 is shown attached to a supporting frame 120 of an existing bed 100 via the first and second mounting bracket assemblies 50*a*, 50*b*. The first and second mounting bracket assemblies 50*a*, 50*b* are mirror-images of each other. Each mounting bracket assembly 50*a*, 50*b* includes an overlapping rectangular first plate 52 and second plate 54.

One end of each first plate 52 is attached to the bed frame 120 using mounting apertures 58 and fasteners 80 such as bolts, rivets, or the like. It is possible that apertures may need to be drilled through the bed frame 120. Each first plate 52 has an intermediately located pivot pin 60 which passes through both that first plate 52 and a second 54 plate. The pivot pins 60 allow pivoting of the second plates 54 with respect to the first plates 52 (which are securely affixed to the bed frame 120). The other end of each first plate 52 includes a first locking aperture 62*a*.

In like manner the second plate 54 includes a second locking aperture 62*b* at an intermediate position. It is intended that during dispensing of a bedding section 25 the bedding roll 20 would be pivoted upward about the pivot pin 60 to a convenient position by pivoting the second plate 54 upward from its normal (lowest) position to align the first and second locking aperture 62*a*, 62*b*. Then a locking pin 82 can be inserted through the now aligned the first and second locking aperture 62*a*, 62*b* to hold the bedding roll 20 in a convenient orientation.

One end of each second plate 54 includes an axle aperture 57 for receiving an end of the support axle 56. The support axle 56 extends across the foot of the existing bed 100 and holds the bedding roll 20. A cotter pin 84 retains each end of the support axle 56 in an associated second plate 54. The cotter pins 84 can be removed to enable a user to replace and/or refile the bedding roll 20 of the roll-out disposable bedding 10 as needed.

The bedding roll 20 may be discreetly stowed under the existing bed 100 when not in use by removing the locking pins 82 from the locking apertures 62*a*, 62*b* and by pivoting the second plates 54 along with the bedding roll 20 downward.

FIG. 3 presents a sectional view of the bedding section 25 taken along section line A-A of FIG. 1. As previously noted each bedding section 25 includes a removably attached pillow case 30 that is temporarily positioned between the upper sheet 22 and the lower sheet 24. The pillow case 30 is beneficially affixed at its corners to the adjacent upper and lower sheets 22, 24. For example the pillowcase 30 may the affixed using a low-adhesion adhesive 32. However other attachment methods may be used such as heat welding (if a suitable pillow case material is used), VELCRO® dots, or the like. It is anticipated that the pillow case 30 will be made of a similar material as the bedding sections 25.

The preferred embodiment of the present invention can be utilized by the common user in a simple and effortless manner with little or no training. After initial purchase or acquisition of the roll-out disposable bedding 10 it would be installed as indicated in FIG. 1.

The method of installing the roll-out disposable bedding 10 may be achieved by: procuring a model of the roll-out disposable bedding 10 having a particular overall size to fit a twin, full, queen, or a king size existing bed 100; procuring a model of the roll-out disposable bedding 10 printed or dyed with a desired color and/or pattern; mounting the roll-out disposable bedding 10 onto the existing bed 100 by installing the first plates 52 of the first and second mounting bracket assemblies 50*a*, 50*b* to the bed 100 using fasteners 80; loading a new bedding roll 20 by securing the second plates 54 in a horizontal position and by inserting the locking pin 82 through the first 62*a* and second 62*b* locking apertures; positioning the bedding roll 20 between the second plates 54; inserting the support axle 56 through the bedding roll 20 and the axle apertures 57 of both second plates 54; and, securing the support axle 56 within the second plates 54 by installing the cotter pins 84. The roll-out disposable bedding 10 is then ready for use.

The method of utilizing the roll-out disposable bedding 10 may be achieved by dispensing a bedding section 25 over the existing mattress/box spring 105 by grasping a leading edge of the exposed bedding section 25 on the bedding roll 20; extending the edge of the bedding section 25 until it completely covers the top 110 of the mattress/box spring 105; lowering the bedding roll 20 to a stowed position below the bed 100 by removing the locking pins 82; separating the perforated side edges 26*b*, 26*c* to provide convenient entry of a user into the bedding section 25 and to expose the pillow case 30; separating the pillow case 30 from between the upper 22 and lower 24 sheets; loading a pillow into the pillow case 30; applying any desired additional bedding such as blankets, comforters, and the like to the existing bed 100; utilizing the existing bed 100 for sleep in a normal manner until such time the bedding section 25 becomes soiled; replacing the soiled bedding section 25 by detaching the bottom perforated edge 26*a* between the soiled bedding section 25 and the attached clean bedding section 25 of the bedding roll 20; disposing of the soiled bedding section 25; repeating the above steps to position a clean and fresh bedding section 25 upon the mattress/box spring 120; and, benefiting from a convenient and time-saving means to apply fresh bedding 25 to a bed 100 afforded a user of the roll-out disposable bedding 10.

The foregoing descriptions of a specific embodiment of the present invention have been presented for purposes of illustration and description. They are not intended to be exhaustive or to limit the invention to the precise forms disclosed. Obviously, many modifications and variations are possible in light of the above teaching. The embodiment was chosen and described in order to best explain the principles of the invention and its practical application, to thereby enable others skilled in the art to best utilize the invention and various embodiments with various modifications as are suited to the particular use contemplated.

What is claimed is:

1. A roll-out disposable bedding assembly, comprising: a bedding roll comprised of disposable bi-layered bedding materials; a first mounting bracket assembly and a second mounting bracket assembly; a support axle; and a pillow case secured between said upper and lower sheets; wherein said first mounting bracket assembly and said second mounting bracket assembly and said support axle are for securing said bedding roll to an existing bed; wherein said bedding roll is comprised of rolled up, sequentially attached rectangular bedding sections; wherein at least one bedding section includes an upper sheet and an attached lower sheet; wherein said upper sheet and said lower sheet have bottoms that are affixed by a joining stitch; wherein said joining stitch extends parallel to said laterally perforated edges; wherein said bedding roll is supported along its sides by said first mounting bracket assembly and said second mounting bracket assemblies, and wherein said first mounting bracket assembly and said second mounting bracket assembly attach to an existing bed frame; wherein said first mounting bracket assembly and said second mounting bracket assembly each include overlapping rectangular first plates and second plates; wherein said first mounting bracket assembly and said second mounting bracket assembly are mirror images; and wherein said first plate of said first mounting bracket assembly is attached to said bed frame using mounting apertures and fasteners.

2. The roll-out disposable bedding assembly according to claim 1, wherein said at least one bedding section connects to adjacent bedding sections along top and bottom laterally perforated edges.

3. The roll-out disposable bedding assembly according to claim 2, wherein said upper sheet and lower sheet are affixed to each other along parallel perforated first and second side edges.

4. The roll-out disposable bedding assembly to according to claim 1, further including a pivot pin which passes through both said first plate and said second plate of said first mounting bracket assembly.

5. The roll-out disposable bedding assembly to according to claim 4, wherein said second plate of said first mounting bracket assembly receives said support axle.

6. The roll-out disposable bedding assembly to according to claim 5, further including first and second locking apertures that can be inserted through both said first plate and said second plate of said first mounting bracket assembly by pivoting said second plate to bring said first and second locking apertures into alignment, wherein inserted first and second locking pins hold said bedding roll in a fixed orientation.

7. The roll-out disposable bedding assembly to according to claim 5, wherein said support axle is received in an axle aperture through said second plate of said first mounting bracket assembly, and further including a pin that retains an end of said support axle in said axle aperture, wherein said pin can be removed to enable removal of said bedding roll.

* * * * *